United States Patent [19]

De Jong et al.

[11] Patent Number: 5,055,735

[45] Date of Patent: Oct. 8, 1991

[54] HIGH PRESSURE DISCHARGE LAMP HAVING IMPROVED CONTAINMENT STRUCTURE

[75] Inventors: Tjitte De Jong, Eindhoven, Netherlands; Florentinus L. M. Bens; Danny L. V. Hermans, both of Turnhout, Belgium

[73] Assignee: U.S. Philips Corporation, New York, N.Y.

[21] Appl. No.: 458,112

[22] Filed: Dec. 28, 1989

[30] Foreign Application Priority Data

Jan. 30, 1989 [NL] Netherlands ..... 8900216

[51] Int. Cl.[5] ..... H01J 17/16; H01J 61/34; H01J 61/52

[52] U.S. Cl. ..... 313/25; 313/573; 313/623; 313/624; 313/634; 362/377

[58] Field of Search ..... 313/25, 573, 634, 623, 313/624, 625, 315, 112, 318, 110; 362/263, 267, 378, 377; 315/49, 56, 60

[56] References Cited

U.S. PATENT DOCUMENTS 4,281,274 7/1981 Bechard et al. ..... 313/578 X
4,539,510 9/1985 Bouchard ..... 313/573 X
4,625,140 11/1986 Gagnon ..... 313/25
4,721,876 1/1988 White et al. ..... 313/25

FOREIGN PATENT DOCUMENTS 290043 9/1988 European Pat. Off. .
495978 11/1938 United Kingdom .

*Primary Examiner*—Donald J. Yusko
*Assistant Examiner*—Ashok Patel
*Attorney, Agent, or Firm*—Brian J. Wieghaus

[57] ABSTRACT

The high pressure discharge lamp has containment structure in the outer envelope which encloses the discharge vessel. The containment structure consists of a glass cylindrical sleeve closed at its ends by a metal plate. The plates, the cylindrical sleeve and the discharge vessel are combined as a subassembly. The metal plates are provided with tongues bearing on the glass cylindrical sleeve and the outer envelope. The lamp has a flexible conductor which extends from the current lead-through conductor remote from the stem to the lamp stem and bears on the outer envelope. The containment structure prevents failure of the outer lamp envelope in the event of explosive failure of the discharge vessel.

19 Claims, 2 Drawing Sheets

HIGH PRESSURE DISCHARGE LAMP HAVING IMPROVED CONTAINMENT STRUCTURE

CROSS-REFERENCES TO RELATED APPLICATIONS

This application is related to copending application Ser. No. 458,111, filed simultaneously herewith, entitled "An Explosion Proof High Pressure Discharge Lamp" of Joseph E. Canale and John P. Dunn, which discloses and claims a high pressure discharge lamp having a sleeve surrounding the discharge vessel in a bulged-tube (BT) envelope.

BACKGROUND OF THE INVENTION

The invention relates to high-pressure discharge lamps which include structure for preventing failure of the outer envelope in the event of explosive rupture of the discharge vessel.

More specifically, high pressure discharge lamps such as metal halide lamps typically include an outer envelope sealed in a vacuum-tight manner and having an axis and an end portion fused with a mount and arranged in a lamp cap provided with contacts. A gas-filled discharge vessel having vacuum-tight seals is axially mounted in the outer envelope. An electric element, such as a pair of discharge electrodes, are axially arranged in the discharge vessel and connected to a first and a second current lead-through conductor emanating from the discharge vessel through a first and a second seal, respectively, near and remote from the mount, respectively. A glass cylindrical sleeve axially is arranged in the outer envelope to surround the lamp vessel and having a first end near the mount and a second end, which sleeve is closed at least at one end. A first and a second current supply conductor extending from the contacts at the lamp cap through the mount to the first and the second current lead-through conductor to energize the discharge vessel to emit light. Frame structure within the lamp vessel and the glass cylindrical sleeve positioned in the outer envelope.

Such an electric lamp is known from GB 495,978. In order to ensure that lamps having a very high operating pressure during operation can be used safely, it is necessary for the lamp vessel to be enveloped within the outer envelope. It should be prevented that upon explosion of the lamp vessel, fragments thereof leave the outer envelope. An explosion can occur both when the electric element is a pair of electrodes and when this element is a filament.

In the known lamp, the mount is provided with a frame, in which the lamp vessel is mounted. A set of wire springs keeps the glass cylindrical sleeve transversely positioned in the outer envelope. A current supply conductor cooperates with a projection on the outer envelope so as to keep both the lamp vessel transversely fixed and the glass cylindrical sleeve transversely and axially fixed.

The construction of the known lamp is not sufficient to ensure that the lamp can be safely used. In fact, the glass cylindrical sleeve is open at one end. Moreover, the construction is complicated. Another disadvantage is that the lamp has a comparatively large diameter, which is disadvantageous with the use in an optical system, in which event the lamp has to be mounted, for example, on the focal line of a reflector. A wide outer envelope then imposes limitations on the shape of the reflector.

SUMMARY OF THE INVENTION

The invention has for its object to provide an electric lamp of the kind described in the opening paragraph, which inter alia has a simple construction and an increased safety.

According to the invention, this object is achieved in that the glass cylindrical sleeve is closed at both ends by a respective metal plate, which is provided with tongues bearing on the glass cylindrical sleeve and being distributed along the circumference thereof, and with tongues bearing on the outer envelope and being distributed along the circumference thereof, the metal plates are rigidly connected to the lamp vessel so as to form a subassembly, the subassembly is carried by the first current lead-through conductor, and the second current lead-through conductor is connected to a flexible conductor bearing on the outer envelope and extending to the mount.

The construction of the lamp according to the invention is simple and saves space, as a result of which a narrow outer envelope is possible. The lamp vessel is unilaterally surrounded by the glass cylindrical sleeve together with the metal plates. The construction ensures that the lamp is also resistant to shocks and vibrations, due to the fact the long current supply conductor is flexible and bears on the outer envelope.

An additional protection against explosion is obtained in a lamp in which the glass cylindrical sleeve is double-walled in that two separated concentric glass tubes are fused together at one end. In a variation of this embodiment, the cylindrical sleeve is double-walled due to the fact that two concentric glass tubes are present at a certain distance from each other and tongues are provided at the metal plates, which fix both tubes. For this purpose, tongues can grip between the two tubes or alternatively first tongues bear on the inner surface of the inner tube and second tongues bear on the outer surface of the outer tube.

It is favourable when tongues grip around a glass cylindrical sleeve and are integrated with the tongues bearing on the outer envelope.

It is also favourable when the tongues bearing on the outer envelope are deformed elastically.

In a preferred embodiment, a free end portion of the tongues bearing on the outer envelope extends over a certain distance to the glass cylindrical sleeve. When the lamp is subjected to a shock, the tongues can be elastically deformed until the free end portion contacts the glass cylindrical sleeve, after which upon a violent shock a further elastic deformation occurs; however, the tongue then behaves as a more rigid spring than before.

The metal plates can be secured to the seals of the discharge vessel. An effective manner of securing the discharge vessel is obtained with metal plates which have oppositely arranged resilient vanes along an opening therein, which vanes are remote from the electric element and hold a seal with clamping fit. The plates can then be mounted in that they are slipped onto a relevant seal. Another possibility consists in that the metal plates are connected to a respective current lead-through conductor, for example in that this conductor is welded to a vane punched out of the relevant plate.

In case the electric element is a pair of electrodes and the lamp vessel has, for example, a sodium-containing gas filling, it is desirable for the envelope of the lamp vessel to be insulated from the current supply conductors in order to avoid losses of, for example, sodium or another element of small dimensions, from the gas filling. In this case, the metal plates can be separated from the current lead-through conductors by insulator bodies, for example of ceramic material, which axially enclose the metal plates and are kept fixed by a widened part at the current lead-through conductors, for example a concentric sleeve or transverse wire secured by welding.

In another favourable embodiment, the first current supply conductor has between the mount and the first current lead-through conductor a lateral loop. In this embodiment, the lamp has high resistance to shocks. In a variation, the first current supply conductor is also secured through an insulator to the metal plate at the first end of the glass cylindrical sleeve. This variation yields a small mechanical load on the means securing the first current supply conductor electrically to the first current lead-through conductor. In a second variation, a kinked conductor on one hand is secured to a metal plate and on the other hand is insulated from the current supply conductors anchored in the mount.

BRIEF DESCRIPTION OF THE DRAWINGS

Embodiments of the electric lamp according to the invention are shown in the drawings. In the drawings.

DESCRIPTION OF THE PREFERRED EMBODIMENTS

Figure 1:
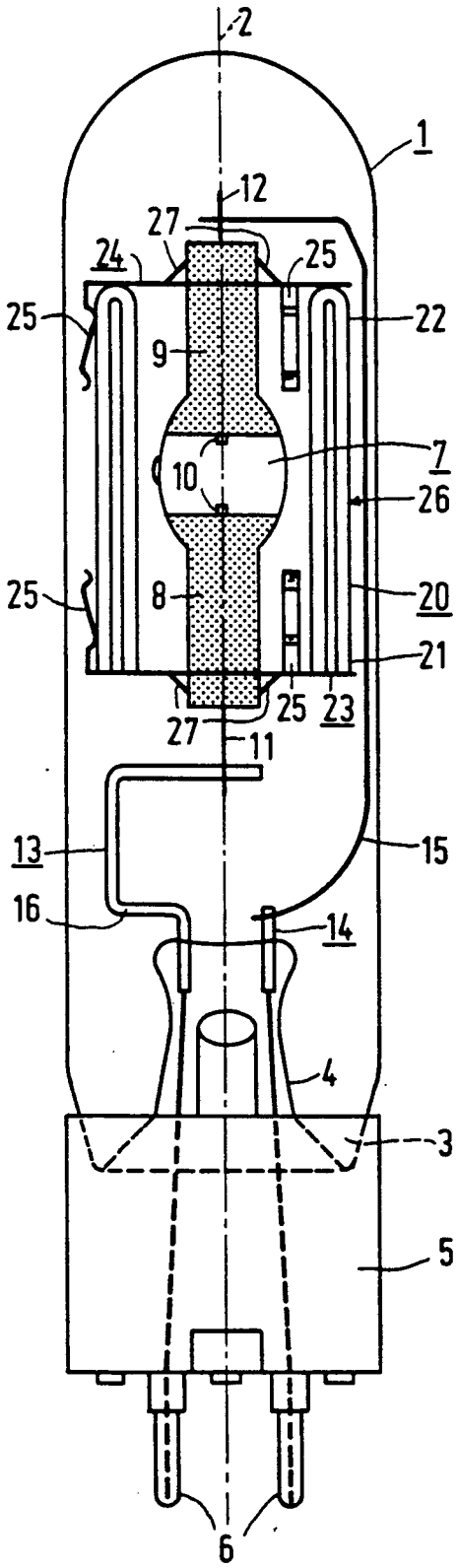
FIG. 1 is a side elevation of a first embodiment.

The electric lamp shown in FIG. 1 has a glass outer envelope 1 sealed in a vacuum-tight manner and having an axis 2 and an end portion 3 fused with a mount 4 and arranged in a lamp cap 5, which is provided with contacts 6. A gas-filled discharge vessel 7 having vacuum-tight seals 8, 9 is axially mounted in the outer envelope 1. An electric element 10, i.e. a pair of electrodes, is axially arranged therein so as to be connected to a first and a second lead-through current conductor 11 and 12, respectively, emanating from the lamp vessel 7 through a first seal 8 and a second seal 9, respectively, near and remote from the mount 4, respectively. A glass cylindrical sleeve 20 is axially arranged in the outer envelope 1 to surround the lamp vessel 7. The cylindrical sleeve 20 has a first end 21 near the mount 4 and a second end 22 and is closed at least at one end. A first current supply conductor 13 and a second current supply conductor 14 extend from the contacts 6 at the lamp cap 5 through the mount 4 to the first and the second current lead-through conductors 11 and 12, respectively. The lamp has means for keeping the lamp vessel 7 and the glass cylindrical sleeve 20 positioned in the outer envelope 1.

The glass cylindrical sleeve 20 is closed at its both ends 21, 22 by a respective metal plate 23, 24, which are provided with tongues 25, which grip around the glass cylindrical sleeve 20 and bear on this sleeve being distributed along the circumference thereof, and with tongues 25, which bear on the outer envelope 1 and are distributed along the circumference thereof. The tongues bearing on the glass cylindrical sleeve 20 and the tongues bearing on the outer envelope 1 are integrated in this Figure. In the FIG. 1, at each plate 23, 24 two tongues 25 are visible. A third tongue is hidden from view behind the tongue 25 on the righthand side of the Figure. The metal plates 23, 24 are rigidly connected to the lamp vessel so as to form a subassembly 26, which is carried by the first current supply conductor 13. The second current lead-through conductor 12 is connected to a flexible conductor 15, which bears on the outer envelope 1 and extends to the mount or stem 4. The glass cylindrical sleeve 20 is double-walled. Two separated concentric tubes are fused together at one end. The metal plates 23, 24 of, for example, manganese/nickel or chromium/nickel, are secured to the seals 8, 9 of the discharge vessel 7. The plates 23, 24 have long openings therein, through which a seal 8, 9 is passed, oppositely arranged resilient vanes 27, which are directed away from the electric element 10 and hold a respective seal 8, 9 with clamping fit. The first current supply conductor 13 has between the mount 4 and the first current lead-through conductor 11 a lateral loop 16.

Figure 2:
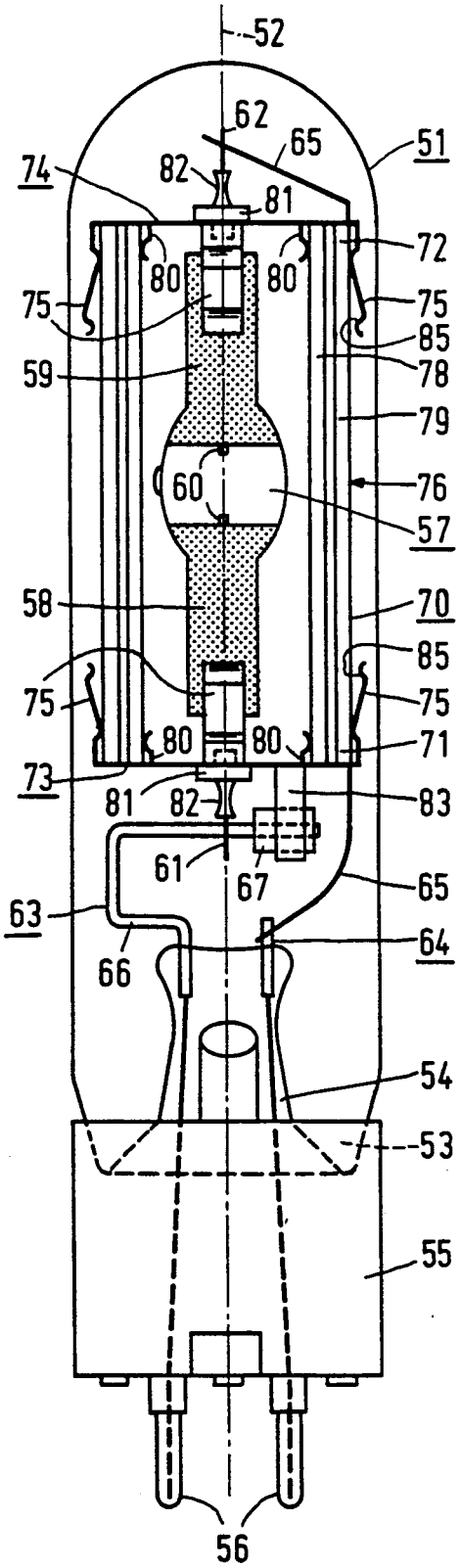
FIG. 2 is a side elevation of a second embodiment.

In FIG. 2, parts corresponding to the parts of FIG. 1 have reference numerals which are 50 higher.

The glass cylindrical sleeve 70 is double-walled and consists of two concentric glass tubes 78, 79. Each metal plate 73, 74 has four tongues 80, of which two at a time are visible, which bear on the inner surface of the inner tube 78. Each metal plate 73, 74 also has four tongues 75, of which three at a time are visible, which grip around the outer tube 79 and press against the wall of the outer envelope 51. The tongues 75 have a free end portion 85, which extends from the outer envelope 51 over a certain distance to the glass cylindrical sleeve 70.

The current lead-through conductors 61, 62 are kept separated from the metal plates 73, 74 by a respective insulator body 81. The insulator bodies have a T-shaped axial cross-section and consist, for example, of ceramic material. They axially enclose the metal plates 73, 74 and are kept fixed by a widened part 82 at the current lead-through conductors 61, 62, i.e. in the drawing a metal sleeve welded on these conductors. The first current supply conductor 63 is partly surrounded by an insulator body 67, which is held by a tongue 83, which is connected to the metal plate 73 at the first end 71 of the glass cylindrical sleeve 70. As a result, this current supply conductor 63 has a second securing means to the metal plate 73 and hence to the assembly 76.

Figure 3:
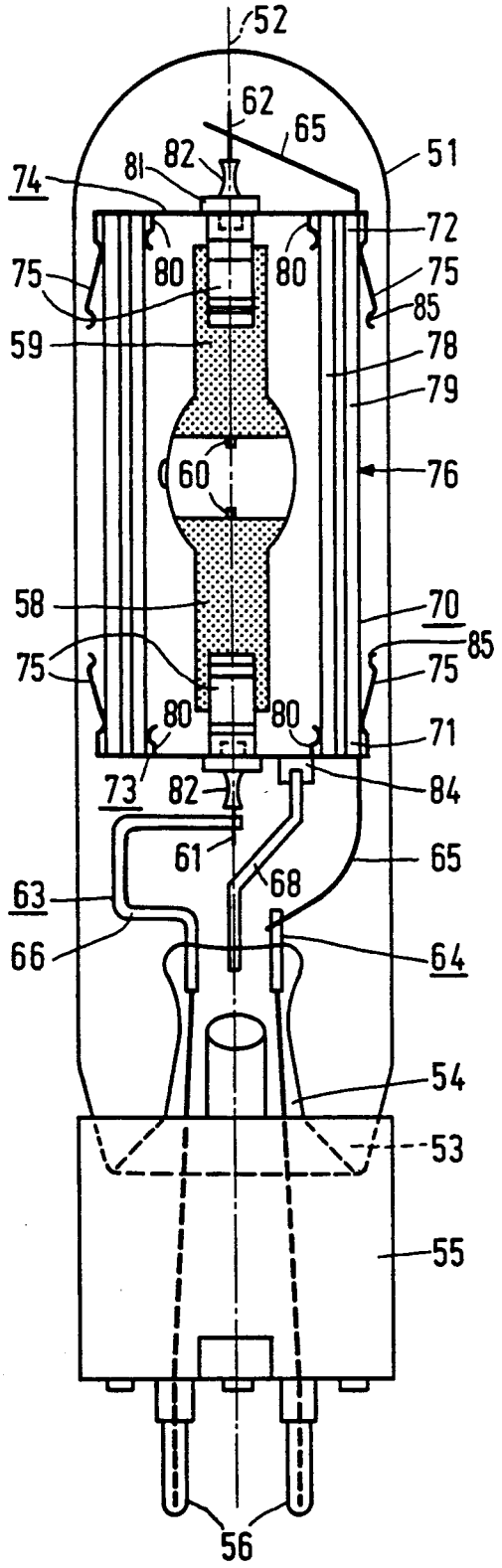
FIG. 3 is a side elevation of a third embodiment.

In FIG. 3, in which the reference numerals correspond to those in FIG. 2, a kinked conductor 68 is anchored in the mount 54 so as to be insulated from the current supply conductors 63, 64 and is secured to a tongue 84 at the metal plate 73.

We claim:

1. An electrical lamp comprising a tubular outer envelope defining a lamp axis, said envelope having a reentrant stem sealing said envelope in a gas-tight manner, a discharge vessel energizable for emitting light and axially arranged in said outer envelope, said discharge vessel having a pair of sealed ends and a pair of lead-throughs each extending through a respective sealed end, a first of said lead-throughs extending towards said stem, a cylindrical glass sleeve surrounding said discharge vesel and having a pair of ends, a first said sleeve end being closer to said stem than other sleeve end, first and second current conductors extending from said reentrant stem, each connected to a respective discharge vessel lead-through, and means for supporting said discharge vessel and said sleeve in said outer envelope, the improvement comprising:

a pair of metal plates each closing a respective end of said sleeve, each metal plate having a first plurality of tongues bearing on said sleeve for supporting said sleeve with respect to said metal plates and a second plurality of tongues bearing on said outer envelope for supporting said metal plates against said outer envelope, said metal plates being rigidly connected to said discharge vessel and forming a subassembly with said sleeve and said discharge vessel, said first current conductor being secured to said first discharge vessel lead-through and supporting said subassembly, and said other current conductor being flexible and extending from said reentrant stem past said subassembly along said outer and envelope and being connected to said second lead-through.

2. An electric lamp as claimed in claim 1, characterized in that said glass cylindrical sleeve is double-walled.

3. An electric lamp as claimed in claim 2, characterized in that said glass cylindrical sleeve has two separated concentric glass tubes, and said metal plates comprise resilient tongues for securing said tubes between said metal plates and separated from each other.

4. An electric lamp as claimed in claim 2, characterized in that said second plurality of tongues bearing on the outer envelope are integrated with said first plurality of tongues gripping around the glass cylindrical sleeve.

5. An electric lamp as claimed in claim 2, characterized in that said tongues have a free end portion extending from said outer envelope over a certain distance to said glass cylindrical sleeve.

6. An electric lamp as claimed in claim 2, characterized in that said metal plates are secured to said sealed ends of the discharge vessel.

7. An electric lamp as claimed in claim 6, characterized in that the metal plates each have an opening therein through which a respective sealed end of the discharge vessel extends, and oppositely arranged resilient vanes at each opening which are directed away from the discharge vessel and hold a respective sealed end with a clamping fit.

8. An electric lamp as claimed in claim 2, characterized in that a respective insulator body separates said metal plates from the respective current lead-throughs, said insulator bodies axially enclosing said metal plates, and each current lead-through has a widened portion for fixing said insulator bodies against said metal plates.

9. An electric lamp as claimed in claim 2, characterized in that the first current conductor has between the mount and the first discharge vessel lead-through a lateral loop.

10. An electric lamp as claimed in claim 9, characterized in that an insulator body is connected to the metal plate at the first end of the glass cylindrical sleeve and said first current conductor.

11. An electric lamp as claimed in claim 9, characterized in that a kinked conductor is secured to the metal plate at the first end of the cylindrical sleeve, which conductor is anchored in the reentrant stem so as to be insulated from said current supply conductors.

12. An electric lamps as claimed in claim 1, characterized in that said second plurality of tongues bearing on the outer envelope are integrated with said first plurality of tongues gripping around the glass cylindrical sleeve.

13. An electric lamp as claimed in claim 1, characterized in that said tongues have a free end portion which extends from the outer envelope over a certain distance to the glass cylindrical sleeve.

14. An electric lamp as claimed in claim 1, characterized in that the metal plates are secured to the sealed ends of the discharge vessel.

15. An electric lamp as claimed in claim 14, characterized in that said metal plates each have openings therein through which a respective sealed end of said discharge vessel is passed and oppositely arranged tongues adjacent said openings directed away from the discharge vessel for holding a respective sealed end with a clamping fit.

16. An electric lamp as claimed in claim 1, characterized in that a respective insulator body separates said metal plates from the respective discharge vessel lead-throughs, said insulator bodies axially enclosing said metal plates, and each discharge vessel lead-through having a widened part for securing said insulator bodies against said metal plates.

17. An electric lamp as claimed in claim 1, characterized in that the first current conductor has a resilient lateral loop between the reentrant stem and the first discharge vessel lead-through.

18. An electric lamp as claimed in claim 17, characterized in that the first current conductor is connected through an insulator body to the metal plate at the first end of the glass cylindrical sleeve.

19. An electric lamp as claimed in claim 17, characterized in that a kinked conductor is secured to the metal plate at the first end of the cylindrical sleeve, which kinked conductor is anchored in the reentrant stem so as to be insulated form the current supply conductors.

* * * * *